United States Patent [19]

Nitschmann et al.

[11] Patent Number: 4,756,221

[45] Date of Patent: Jul. 12, 1988

[54] SAW CHAIN

[75] Inventors: Karl Nitschmann, Schorndorf; Hans Dolata, Waiblingen; Werner Hartmann, Ostfildern, all of Fed. Rep. of Germany

[73] Assignee: Andreas Stihl, Waiblingen, Fed. Rep. of Germany

[21] Appl. No.: 7,746

[22] Filed: Jan. 28, 1987

[30] Foreign Application Priority Data

Jan. 29, 1986 [DE] Fed. Rep. of Germany ..... 3602568

[51] Int. Cl.[4] ..... B27B 33/14

[52] U.S. Cl. ..... 83/833; 83/830; 83/834

[58] Field of Search ..... 83/834, 833, 831, 830, 83/832

[56] References Cited

U.S. PATENT DOCUMENTS

| | | | |
|---|---|---|---|
| 4,122,741 | 10/1978 | Engman et al. | 83/834 |
| 4,558,621 | 12/1985 | Nitschmann et al. | 83/834 |
| 4,590,836 | 5/1986 | Doiron | 83/834 |

FOREIGN PATENT DOCUMENTS

| | | |
|---|---|---|
| 2733726 | 2/1979 | Fed. Rep. of Germany . |
| 83/03379 | 3/1983 | PCT Int'l Appl. . |

*Primary Examiner*—Donald R. Schran
*Attorney, Agent, or Firm*—Walter Ottesen

[57] ABSTRACT

A saw chain has pivotally interconnected chain links which includes cutting links and safety links and these links are effective as working links. The cutting links are each provided with a cutting tooth for cutting into wood and the safety links are each provided with a projection which limits the depth of the cut of the cutting tooth which follows the safety link. The pivot axes of the chain links lie in an action plane above the guide bar in the stretched portion of the saw chain when the latter is subjected to the pulling force exerted by the drive of the chain saw. The cutting links are pivotable with respect to this plane. In addition, the safety links can also be pivotable in this manner. When the cutting links are in their pivoted-out position under this pulling force, no clearance angle is available at the roof of the cutting tooth so that the cutting edge has no cutting effect. For this reason, there is no kickback when the saw chain is placed against the wood. When an advancing thrust is applied to the chain saw, the cutting links in the stretched running portion of the chain are pivoted into their pivoted back position or working position by means of reaction forces; whereas, in the direction-reversal region of the guide bar, the cutting links are retained in their pivoted-out position by means of the support imparted to the drive links by the nose sprocket of the guide bar. In this way, the danger of kickback remains low.

10 Claims, 7 Drawing Sheets

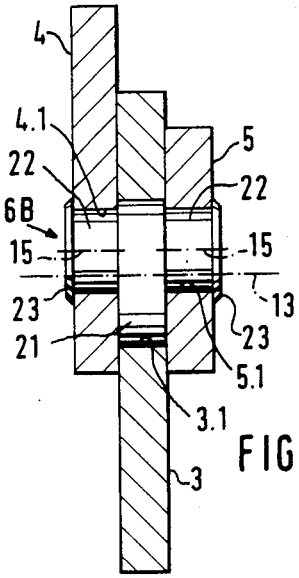
FIG.6
FIG.7
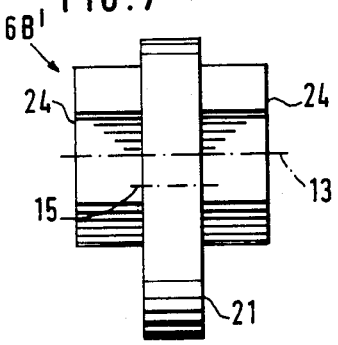
FIG.8
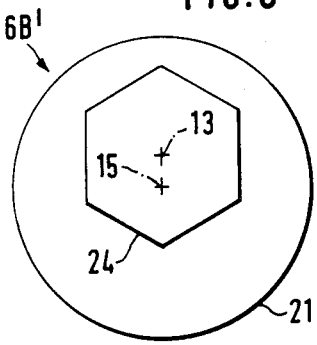
FIG.9
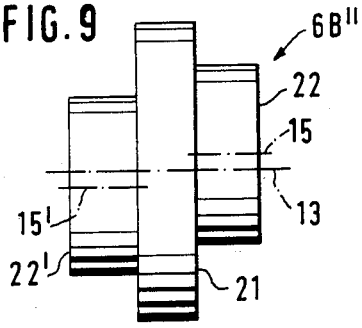
FIG.10
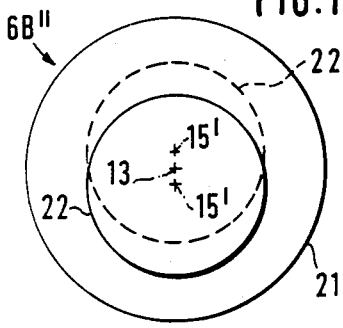

SAW CHAIN

FIELD OF THE INVENTION

The invention relates to a saw chain for use with a chain saw having a guide bar equipped with a direction-changing sprocket wheel mounted at one end thereof and defining a bearing surface along its length. The saw chain includes working links in the form of cutting links and safety links as well as chain links configured as driving links and connecting links. Each of the links has two bores disposed one behind the other when viewed in the direction of movement of the saw chain. The bores accommodate transverse pins or rivets defining respective central axes which define pivot axes and these axes lie parallel to each other in a common plane of action when the chain is stretched and under tension force. At least several of the working links are pivotable with respect to this plane of action and are connected with both rivets in such a manner that in their out-pivoted positions, their outer edges in the region of the rearward rivet (viewed in the direction of movement of the saw chain) lie at a spacing from the bearing surface parallel to the plane of action.

BACKGROUND OF THE INVENTION

German published patent application DE-OS No. 27 33 726 discloses a saw chain having cutting links and connecting links lying next to each other. The cutting links and the connecting links are made pivotable in that they have a lower elevation beneath the rear bore (viewed in the direction of movement of the saw chain) as in the region of the other bore so that in the stretched condition of the saw chain, a spacing results between the guide bar and the rear part of these pivotable chain links. The cutting links can therefore become positioned at different angles in accordance with the resistance occurring in the wood that is being cut; however, they always maintain their working position in that the roof of the cutting tooth formed on the cutting link has a clear angle suitable for the cut.

Published International patent application PCT-WO No. 83/03379 discloses a saw chain having cutting links which become displaced radially outwardly in the turn-around or direction-reversal region of the guide bar. For this purpose, the drive links of the chain which engage the gullets of the nose sprocket are asymmetrically configured. This construction is difficult and expensive. Furthermore, this configuration of the drive links leads to an additional loading in the region where they mesh with the nose sprocket and therefore leads to greater wear.

SUMMARY OF THE INVENTION

It is an object of the invention to provide a saw chain wherein a load-dependent control of the displaceable chain links is possible in that portion of the saw chain which runs in a straight line, while the cutting forces in the direction-reversal region are always reduced so that the danger of kickback is lessened with a reduced wear of the saw chain.

The saw chain of the invention is for a motor-driven chain saw equipped with a guide bar and a drive motor for imparting a pulling force to the saw chain for moving the latter around the guide bar, the guide bar having substantially linear upper and lower guide paths on its upper and lower edges, respectively, for guiding the saw chain and having a nose sprocket at its outermost end for directing the chain saw from one of the guide paths to the other one of the guide paths, the guide paths defining respective bearing surfaces along which the saw chain glides as it moves around the guide bar, and the saw chain being subjected to reaction and cutting forces as the guide bar is advanced into the wood to be cut. The saw chain includes: a plurality of cutting links, a plurality of safety links, a plurality of connecting links and a plurality of driving links, the links being pivotally interconnected by rivets to define the saw chain; the cutting links and the safety links defining a plurality of working links; each of the links including a plate-like body having a rearward bore for accommodating one of the rivets and a forward bore for accommodating another one of the rivets; the bores being located in the plate-like bodies of the links so as to cause the rivets to define respective pivot axes which are mutually parallel and lie in a common action plane located at a predetermined distance from the bearing surface when the saw chain is under the tension imparted thereto by the pulling force; each of the working links having an upper working part facing away from the guide bar for acting upon the wood to be cut and a lower edge lying opposite the upper working part and being disposed in the region of the rearward bore, the upper working part having a rearward outer edge; the upper working part of the cutting links each having a cutting edge defining a flight path as the saw chain moves around the guide bar at a predetermined distance from the guide bar; and, pivot means pivotally connecting at least selected ones of the working links into the saw chain so as to cause each of the selected working links to pivot from a first position whereat the lower edge is at a predetermined spacing from the bearing surface of the guide path and whereat the rearward outer edge protrudes outwardly beyond the flight path when the saw chain is under tension and in the absence of the advancing and the cutting forces and a second position whereat the lower edge lies approximately in the plane of one of the bearing surfaces in response to the advancing and the cutting forces thereby providing the cutting edges of the cutting links with a predetermined clearance angle for penetrating and cutting the wood.

As a consequence of the above-described configuration and journalling of the pivotable working links, the cutting links are substantially ineffective during the idle mode of operation. This position in which the cutting links are ineffective remains in the direction-reversal region; whereas, the working position is attained under the action of reaction forces resulting from the advancing thrust applied by the operator to the chain saw and from the cutting force on the straight-line portion of the saw chain.

BRIEF DESCRIPTION OF THE DRAWING

The invention will now be described with reference to the drawing wherein:

FIG. 6 is an enlarged section view taken along line VI—VI of FIG. 2;

FIG. 7 is a transverse pin or rivet according to another embodiment for the saw chain of FIGS. 1 to 5 seen in the direction of movement of the saw chain;

FIG. 8 is an end view of the rivet of FIG. 7 seen in the direction of the axis of the rivet;

FIG. 9 is a further embodiment of the rivet for the saw chain of FIGS. 1 to 5 corresponding to the view seen in FIG. 7;

FIG. 10 is an end view in the direction of the axis of the rivet of FIG. 9;

DESCRIPTION OF THE PREFERRED EMBODIMENTS OF THE INVENTION

Figure 1:
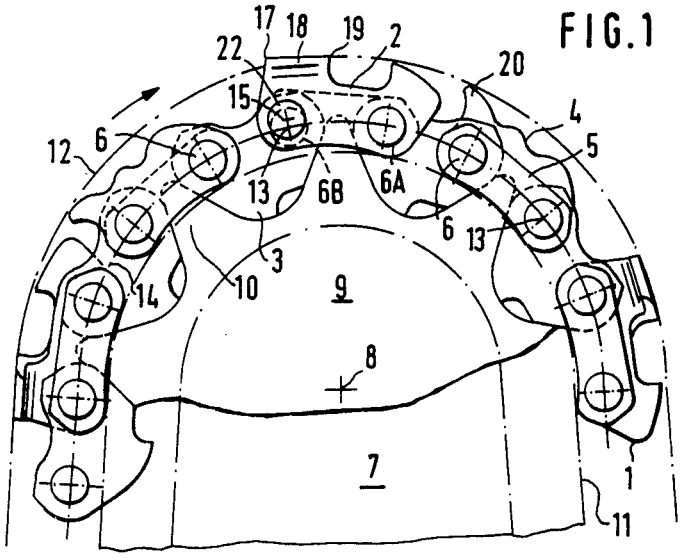
FIG. 1 is a side elevation view of the forward direction-reversal region of a guide bar on which a saw chain is shown guided on a nose sprocket, this view further showing a cutting link displaced outwardly by means of an eccentric pivot connection.

The saw chain 1 illustrated in FIGS. 1 to 5 includes cutting links 2, driving links 3, safety links 4 and connecting links 5. These chain links are pivotally interconnected by means of transverse pins or rivets 6, 6A and 6B. The cutting links 2, the safety links 4 and the connecting links 5 are all configured as side links in the illustrated embodiment; whereas, the drive links 3 are each connected between two of these side links. The cutting links 2 define working links. The safety links 4 prevent the cutting links from cutting too deeply into the wood and therefore likewise serve as working links.

Figure 2:
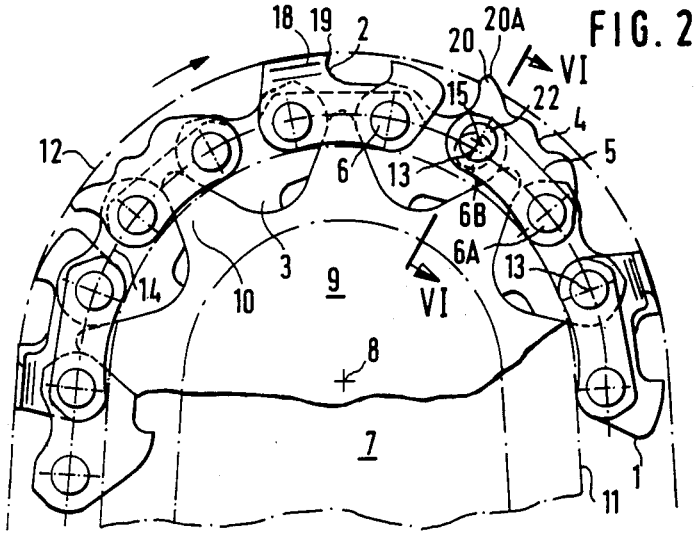
FIG. 2 is a side elevation view corresponding to that of FIG. 1 wherein a safety link of the saw chain is eccentrically pivoted outwardly.
Figure 3:
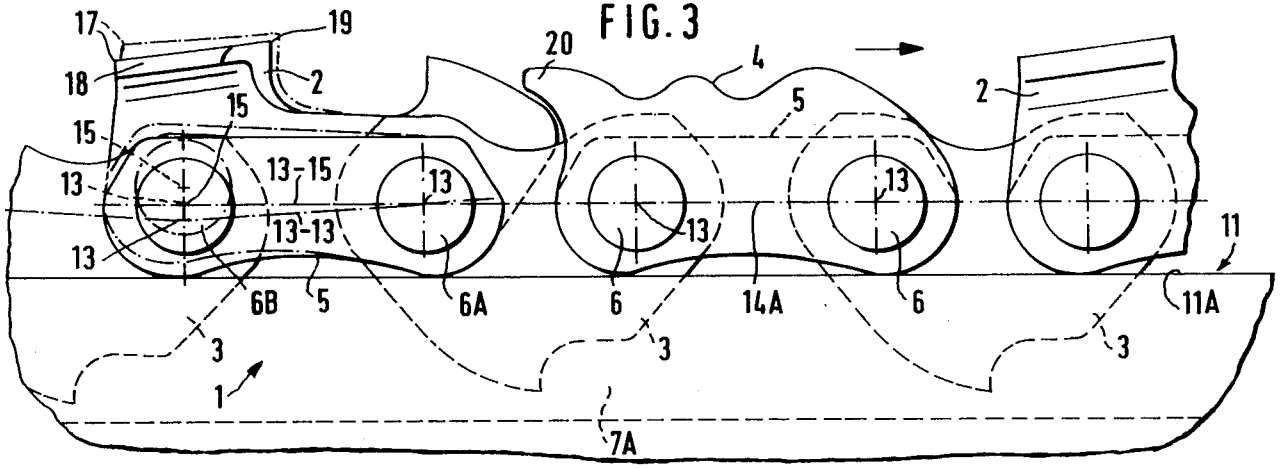
FIG. 3 is a side elevation enlarged view of a cutaway portion of the saw chain of FIG. 1 wherein the saw chain is in its stretched position.
Figure 4:
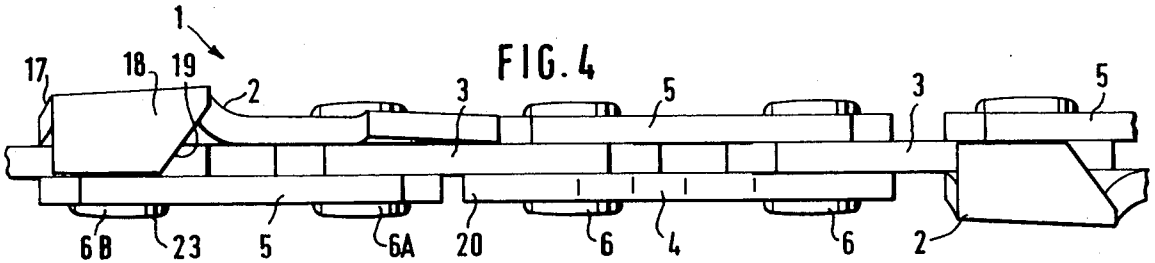
FIG. 4 is a plan view of the saw chain of FIG. 3.

As shown in FIGS. 1 to 3, the saw chain 1 is driven in the direction of the arrow around the periphery of a guide bar 7. The guide bar 7 is part of a hand-held portable chain saw which is not shown in the drawing. A direction-reversal sprocket 9 is journalled in the forward end region of the guide bar 7 so as to be freely rotatable about the direction-reversal axis 8 for changing the direction of the saw chain as it moves around the guide bar. The direction-reversing sprocket 9 is caused to rotate by the drive links 3 of the saw chain as the latter are moved around the periphery of the guide bar. With this movement, the drive links 3 engage the gullets between respective pairs of mutually adjacent teeth 10 of the sprocket 9. The drive links 3 engage a groove 7A of the guide bar 7 on the straight-line portion thereof as shown in FIG. 3. During this movement along the guide bar, the foot tips of the drive links 3 are spaced from the base of the groove 7A.

The saw chain 1 runs along a guide 11 which defines the bearing plane 11A of the chain 1. The cutting links 2 have cutting edges 19 whose flight path 12 is represented by a dot-dash line (FIGS. 1 and 2). The center axes 13 of the rivets 6, 6A and 6B define pivot axes and move in a plane 14 around the guide bar. The plane 14 is curved in the region of the sprocket 9 and for the portion of the saw chain 1 stretched under pulling tension, the plane 14 defines an action plane 14A which in the side elevation view of FIG. 3 is a line of action in which the pulling force is concentrated.

Several working links are pivotable parallel to the plane of the guide bar 7. FIG. 3 shows a pivotable cutting link 2 and FIG. 5 a pivotable safety link 4. For these pivotable chain links, the rivet 6A, running ahead when viewed in the direction of the arrow, is configured as the other rivets 6; whereas, the rearward rivet 6B has two aligned portions 22 eccentric to the center axis 13 (FIG. 6). The portions 22 define a further transverse axis 15 parallel to the axis 13.

The arrangement of the pivotable safety link 4 on the rivet 6B is shown in section in FIG. 6. The pivotable cutting link 2 is mounted in the same manner on the rivet 6B corresponding thereto. The two eccentric portions are configured as trunnions 22 which lie on respective sides of the center portion 21 of the rivet 6B. The drive link 3 with its bore 3.1 is journalled on the center portion 21. The one trunnion 22 penetrates the bore 4.1 of the safety link 4 and, on the other trunnion 22, the connecting link 5 is mounted with its bore 5.1. The trunnions 22 have rivet heads 23 which lie against the outer surfaces of the safety link 4 and the connecting link 5, respectively. Such a rivet head connection is conventional in saw chains. In contrast, the trunnions 22 can be connected with the chain links 4 or 5 by means of electron-beam welding or laser welding whereby a more rational production of the saw chain can be achieved. With this rigid connection, the rivet 6 rotates in the center link 3 when the chain links 4 and 5 pivot relative to link 3. The center portion 21 of the rivet 6 has a larger diameter than the trunnions 22 which are of the same cross section.

The two outer chain links 4 and 5 or 2 and 5 are displaced via the rivet 6B with respect to the center chain link 3 with the common axis 15 of both outer chain links lying farther out than the axis 13 when referred to the guide bar 7. In this way, the rearward outer edge 17 of the cutting tooth 18 of the cutting link 2 is pivoted outwardly when the saw chain is running at idle. The same condition applies to the rearward outer edge 20A of the projection 20 of the safety link 4. From this arrangement, it follows that the rearward outer edge 17 of the cutting tooth 18 of the cutting link 2 pivotally connected in this manner projects outwardly beyond the flight path 12 of the cutting edge 19 in all regions of the chain when the saw chain is simply loaded by tension by means of the drive, that is, in the absence of an advancing thrust applied by an operator to the chain saw and cutting forces associated therewith. A clear cutting angle extending from the cutting edge 19 is not provided when the cutting link is in this position.

The axis 15 of the eccentric trunnion 22 is always at a greater spacing with respect to the direction-reversing axis 8 of the sprocket 9 than the pivot axis 13 of the rivet 6B. The drive links 3 are held by the sprocket 9 in their alignment to the guide bar 7 so that the pivot axes 13 always run in the plane 14. The cutting links 2 are mounted on the one eccentric trunnion 22 with their rearward bore 2.1, and therefore, are pivoted outwardly somewhat as described above when the saw chain runs at idle, that is, when only the tension force generated by the drive acts upon the chain. This position of the pivotable cutting link 2 is shown in FIG. 3 by the dot-dashed outline.

If the saw chain is loaded as a consequence of an advancing thrust in wood or by means of cutting forces, the pivotable cutting links 2 can pivot back in the direction toward the guide bar 7 in the region of the portion of the chain running in a straight line. In this back pivot movement, the cutting links 2 take along the connecting links 5 and the drive links 3 via the eccentric rivets 6B. This pivot movement is only possible in the straight-line portion of the guide 11 because there the cutting links 2 and the connecting links 5 are somewhat lifted from the guide 11 in the region beneath the rivet 6B for the chain loaded only by tension force and the drive links 3 are at a spacing from the base of the groove 7A. FIG. 3 shows the pivoted position with solid lines, that is, the working position of the cutting link 2. By means of the back pivot movement of the cutting link, the clearance angle is achieved at the roof of the cutting tooth 18 which is necessary for the cutting edge 19 to cut into the wood.

In this way, a defined forced control of the cutting links is achieved in the portion of the saw chain running in a straight line. In this connection, and as a consequence of the reduction of the clearance angle of the cutting tooth occurring in accordance with loading, the chip removal of the wood to be cut is reduced in this region so that the wear is reduced and furthermore, the kickback effect is substantially eliminated. This kickback effect is the unintended and unforeseeable backward thrust of the chain saw during the cutting operation.

In the region of the sprocket 9, the outwardly pivoted position of the cutting link 2 is maintained because the drive links 3 fit into the gullets between the teeth 10 of the sprocket and therefore do not permit a pivot movement of the chain links 2 and 5 connected to the drive links 3 via the eccentric. In the direction-reversal region of the guide bar, the cutting teeth 18 therefore always have a negative clearance angle (FIG. 3), so that practically no cutting forces occur there and the forward thrust forces cannot give rise to any kickback of the chain saw.

Figure 5:
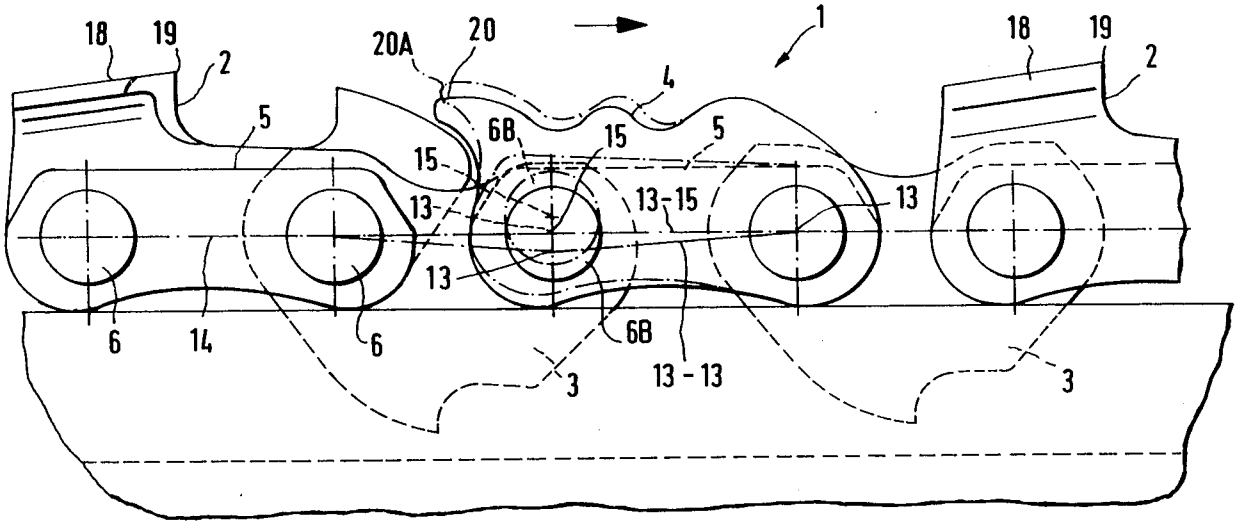
FIG. 5 is a side elevation enlarged view of a cutaway portion of the saw chain of FIG. 2 in its stretched condition.
Figure 11:
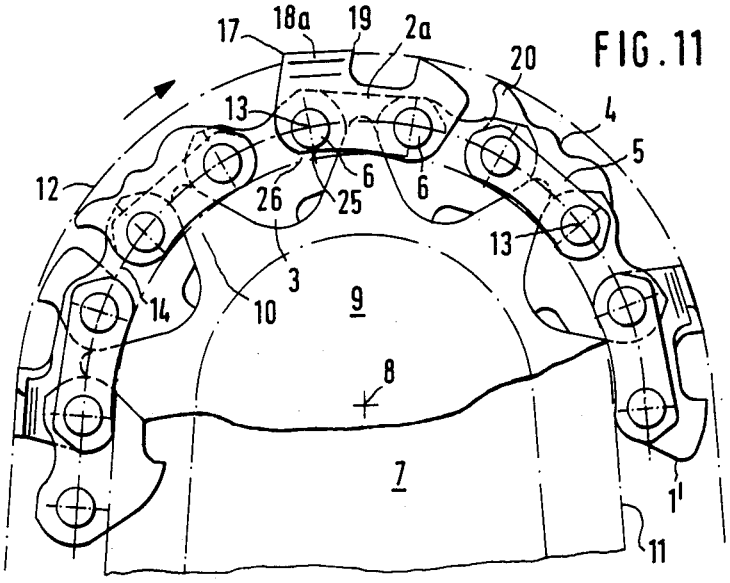
FIG 11 is another embodiment of the saw chain in a side elevation view corresponding to that of FIG. 1 with a cutting link displaced outwardly.

In FIG. 5, the outward pivoted position of the pivotable safety link 4 is shown in dot-dash outline and the working position of this chain link is shown in solid lines. The projection 20 formed at the rearward portion of the safety link 4 is pivoted outwardly under the tension load of the chain to the extent that its rearward outer edge 20A extends beyond the flight path 12 as also shown in FIG. 2. In this position, the safety link prevents the penetration into the wood of the cutting link 2 which follows from the rear. During operation of the saw chain, the pivotable safety links 4 in the straight-line region of the guide 11 can pivot back in the direction toward the guide bar when the reaction force, which is generated by an advancing thrust of the chain saw, acts upon the links 4. FIG. 5 shows this position in solid lines. In the direction-reversal region of the guide bar, the eccentrically, pivotally connected safety links 4 remain in the outwardly pivoted position because the drive links 3 prevent a back pivot action as a consequence of their engagement in the sprocket 9. The projection 20 of the safety link therefore always extends outwardly beyond the flight path 12 in the direction-reversal region of the saw chain whereby the saw tooth 18 following behind the projection 20 becomes substantially ineffective.

Since the reaction forces in response to the advancing thrust primarily cause a kickback of the chain saw when the guide bar is applied to the wood with its forward end (plunge cutting), the position of the projection 20 of the safety link beyond the flight path which is always present in this region provides an especially effective protection against kickback action. Furthermore, a smoother running of the saw chain 1 is achieved.

As shown from FIGS. 3 and 5, the connecting line 13–15 between the axis 13 of the forward rivet 6A and the eccentric axis 15 form an acute angle with the connecting line 13—13 of both pivot axes 13. The connecting line 13—13 lies in the action plane 14A for the outwardly pivoted position of the working links 2 or 4 and this connecting line pivots about the axis 13 of the forward rivet 6A out of the action plane 14A in a direction toward the guide bar 7 with a back pivoting of the working link. In the working position of the cutting link 2 or of the safety link 4, the connecting line 13–15 lies in the action plane 14A.

FIGS. 7 and 8 show a rivet 6B′ of another configuration. This rivet has a lateral eccentric trunnion 24 which is configured to have six flats so that they may be connected to the corresponding chain links in a form-tight manner. Another multiple-flat form can be selected. The eccentric portions can also be configured so as to have an oval or non-circular form in order to provide a form-tight connection with the chain links. When the chain link which is to be pivoted, that is the cutting link or safety link, is mounted as a center link between two side links, the rivet can be so mounted that its two lateral trunnions lie so as to be coaxial with axis 13 which runs in the plane 14 (FIG. 1) while the center portion 21 defines the eccenter on which the corresponding cutting link or safety link is journalled. This is indicated in FIGS. 7 and 8 by an exchange of the axes 13 and 15 compared to FIG. 6.

The rivet 6B″ according to FIGS. 9 and 10 has two eccentric trunnions 22′ which are circular in cross section. The eccentric trunnions 22′ are arranged so as to be non-coaxial so that two eccentric axes 15′ are formed which lie above and below the pivot axis 13 to which the center portion 21 is concentric. In this way, different pivot paths are provided for the two side chain links which are to be mounted on the eccentric trunnions 22′.

The invention can also be realized in that instead of utilizing eccentric rivets, another form of the chain links which are to be controlled is selected and, for the outwardly pivoted position of the particular chain link, there is likewise provided a gap between the lower edge of this chain link beneath the rivet and the guide bar and which gap permits a back pivoting of the chain link in the direction toward the guide bar in the straight-line region of the guide 11.

Figure 12:
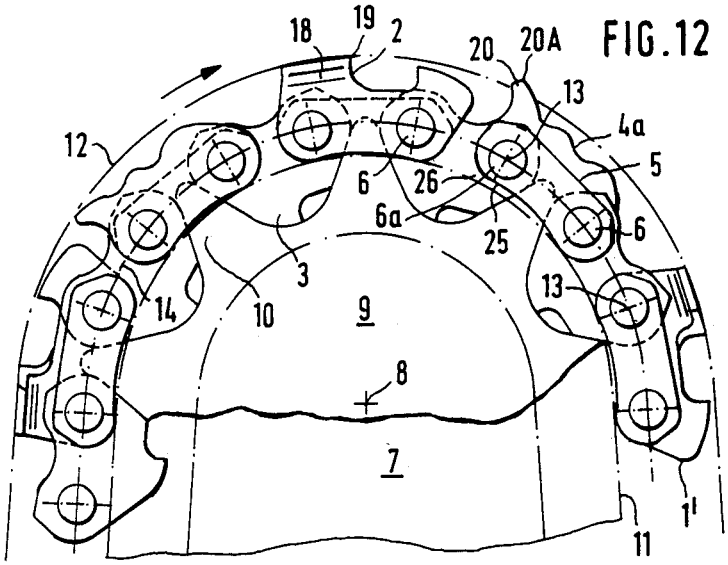
FIG. 12 is a side elevation view corresponding to the view of FIG. 11 showing a saw chain with a safety link displaced outwardly.
Figure 13:
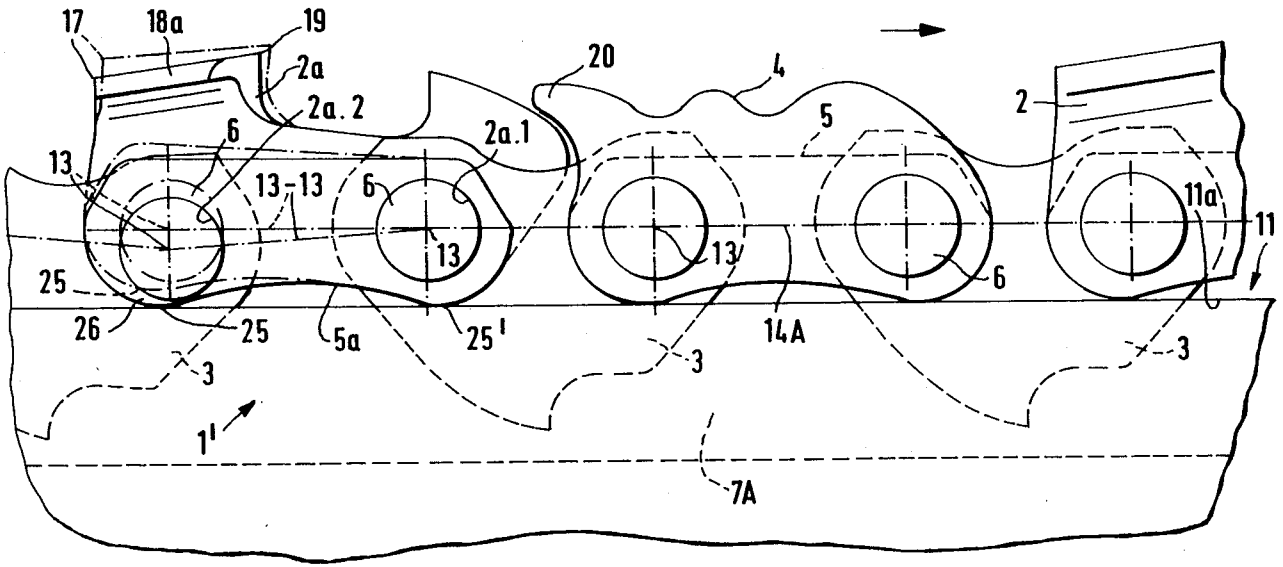
FIG. 13 is a side elevation enlarged view of a cutaway portion of the saw chain of FIG. 11 in its extended or stretched position with the cutting link, loaded by means of a thrust force applied by the operator, being shown in its working position by solid lines; and, FIG. 14 is a side elevation enlarged view of a cutaway portion of the saw chain of FIG. 12 in its extended position with the safety link in its working position shown in solid outline and loaded with a thrust force.
Figure 14:
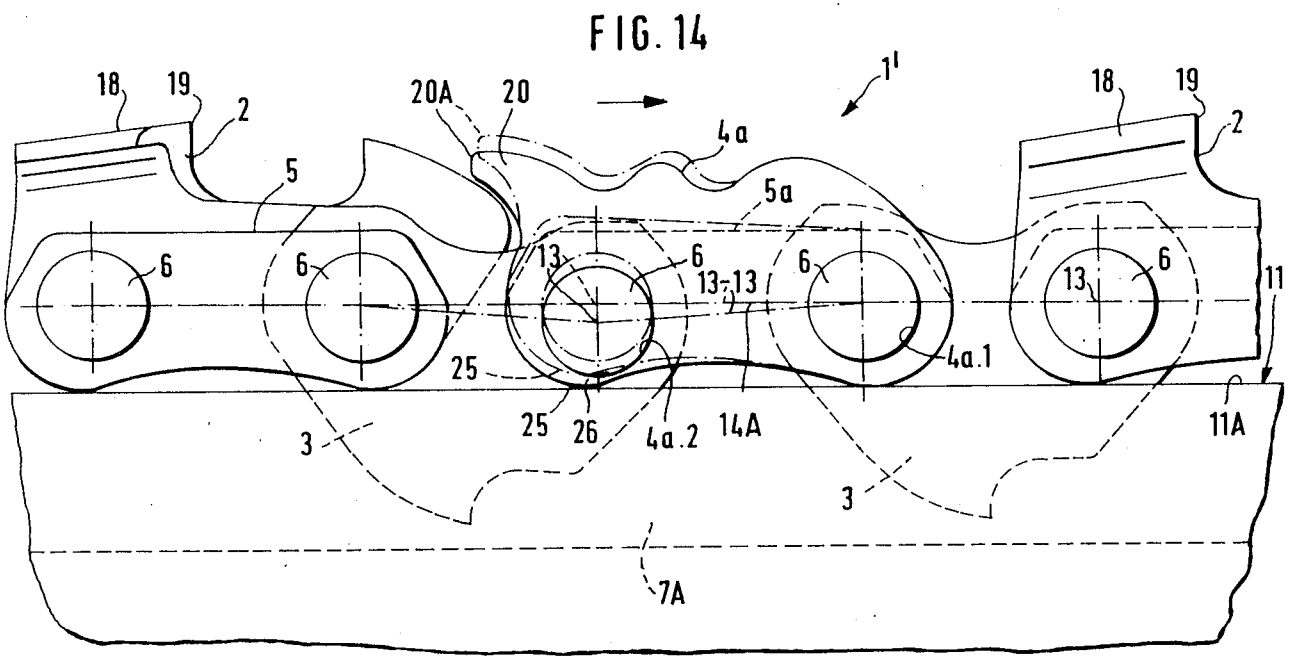

FIGS. 11 to 14 show such an embodiment for a cutting link 2*a* (FIGS. 11 and 13) and for a safety link 4*a* (FIGS. 12 and 14). It is noted that the saw chain 1′ corresponds to the chain 1 of FIGS. 1 to 5. However, to interconnect the chain links, conventional rivets 6 without eccentric trunnions are provided exclusively. The chain link to be controlled, namely, the cutting link 2*a* (FIGS. 11 and 13) and/or the safety link 4*a* (FIGS. 12 and 14) is so configured that its two bores 2*a*.1 and 2*a*.2 or 4*a*.1 and 4*a*.2 have different spacings between their lower edges and the respective points 25 or 25′ of the lower edge which is located beneath the bore and with which lower edge the chain link lies upon the guide bar when in the in-pivoted position in the straight-line region of the guide 11 and when the saw chain is loaded with advancing thrust and cutting forces. The connecting line between the two outermost points 25 and 25' of the edge of the chain link facing toward the guide bar therefore runs at an acute angle to the line which connects the two lowermost points of the bores 2a.1 and 2a.2 or 4a.1 and 4a.2. The drawings show the chain links 2a and 4a in their out-pivoted position with dot-dashed lines. The controlled chain links are in this position when the saw chain is placed under tension exclusively by means of the drive, that is, when the saw chain runs around the periphery of the guide bar in the idle mode of operation.

As shown in FIGS. 13 and 14, the chain link (2a or 4a) is journalled with the bore (2a.2 or 4a.2) which lies closer to the corresponding point 25 of the lower edge, on the one rivet 6 and, with the other bore, on the other rivet 6, and between the point 25 of the chain link edge and the guide 11, a gap 26 is formed in the out-pivoted position of the chain link. The connecting link 5a corresponding to the cutting link 2a is likewise unsymmetrically configured with respect to the position of the bores so that also its lower edge (referred to the direction of movement around the guide bar) in the rearward region has a smaller spacing to the bore axis 13 than in the forward region and a gap corresponding to the gap 26 also is provided between the connecting link 5a and the guide 11 when the chain is in the idle mode of operation.

The rearward outer edge 17 of the cutting tooth 18a projects beyond the flight path 12 in the idle mode of the chain by an amount equal to the width of the gap 26 so that the clear angle extending from the cutting edge 19 is in this position very small or zero. For this situation, the axes 13 of all rivets 6 lie in the plane 14 of movement. During cutting operation, an advancing force is applied and, as a consequence of the reaction forces and the cutting forces, the cutting link 2a, which is located on the straight-line portion of the guide 11, pivots into the working position (FIG. 13) shown by the solid lines with the connecting links 5a being taken along and the gap 26 being closed because the edge of the cutting link lies against the guide 11 with the point 25 thereof and is therefore in the bearing plane 11A. With this pivoting action into the working position, the rearward outer edge 17 of the cutting tooth 18a pivots so far in the direction toward the guide bar that the clearance angle required for the cut is reached. In contrast, in the direction-reversing region, the cutting link 2a is supported on the sprocket 9 by the drive link connected therewith so that it cannot pivot. It therefore remains in the position in which a clearance angle of the saw tooth 18a is unavailable or is negative (FIG. 11) so that practically no cutting forces occur at the forward end of the guide bar and therefore, as mentioned earlier, the kickback effect is substantially eliminated.

The safety link 4a is journalled in the same manner and, as shown in FIG. 14, as a consequence of the tension force acting on the chain in the idle mode thereof, is likewise pivoted outwardly (dot-dashed position) and is pivoted back into the position shown with the solid lines when it runs through the kerf. Accordingly, on the straight-line portion of the guide 11, the projection 20 then lies with its rearward outer edge 20A on or within the flight path 12; whereas, in the direction-reversal region, it retains its out-pivoted position. The defined forced control of the chain links, which is dependent upon tension load, reduces wear with the control of the cutting links providing the special advantage that the cutting of the wood in the straight-line region of the guide bar is dependent on load; whereas, in the direction-reversal region, the cutting force is always greatly reduced. In this way, an unexpected kickback of the chain saw is substantially prevented.

In this embodiment too, the connecting line 13—13 of the two bolt axes 13 pivots about the forward pivot axis 13 when the cutting link 2a or the safety link 4a is pivoted. With this pivoting movement of the working link into its working position, the connecting line 13—13 is pivoted out of the action plane 14A in the direction toward the guide bar 7 and then defines an acute angle with this action plane.

In both embodiments, it is preferable that all cutting links and all safety links of the saw chain are configured and journalled in the manner described. The cutting links can all be configured to correspond to the one embodiment and the safety links can all be configured to correspond to the other embodiment. A saw chain according to another embodiment of the invention can contain only the cutting links or only the safety links configured and journalled in the manner disclosed.

If only several working links of the saw chain are configured and journalled in the manner according to the invention, the cutting links then remaining effective will cut into the wood in the direction-reversal region of the saw chain so that at this location there is still a cutting force available which, however, is reduced when compared to the conventional saw chain. This can be advantageous for the cut to be made with the kickback danger nonetheless reduced.

It is understood that the foregoing description is that of the preferred embodiments of the invention and that various changes and modifications may be made thereto without departing from the spirit and scope of the invention as defined in the appended claims.

What is claimed is:

1. A saw chain for a motor-driven chain saw equipped with a guide bar and a drive motor for imparting a pulling force to the saw chain for moving the latter around the guide bar, the guide bar having substantially linear upper and lower guide paths on its upper and lower edges, respectively, for guiding the saw chain and having a nose sprocket at its outermost end for directing the saw chain from one of said guide paths to the other one of said guide paths, the guide paths defining respective bearing surfaces along which the saw chain glides as it moves around the guide bar, the saw chain being subjected to advancing and cutting forces as the guide bar is advanced into the wood to be cut, the saw chain comprising:

a plurality of cutting links, a plurality of safety links, a plurality of connecting links and a plurality of driving links, the links being pivotally interconnected by a plurality of forward pivot means and a plurality of rearward pivot means to define the saw chain;

said cutting links and said safety links defining a plurality of working links;

each of said links including a plate-like body having a rearward bore for accommodating one of said rearward pivot means and a forward bore for accommodating one of said forward pivot means;

said bores being located in the plate-like bodies of said links so as to cause said pivot means to define respective pivot axes which are mutually parallel and lie in a common action plane located at a predetermined distance from said bearing surface when the saw chain is under the tension imparted thereto by said pulling force;

each of said working links having an upper working part facing away from the guide bar for acting upon the wood to be cut and a rearward lower edge lying opposite said upper working part and being disposed in the rearward outer edge;

the upper working part of said cutting links each having a cutting edge defining a flight path as the saw chain moves around the guide bar at a predetermined distance from said guide bar;

said forward pivot means pivotally connecting said working links into said saw chain; and, at least selected ones of said rearward pivot means including ancillary means for permitting corresponding selected ones of said working links to pivot downwardly about said forward pivot means from a first position whereat said rearward lower edge is at a predetermined spacing from the bearing surface of the guide path and whereat said rearward outer edge protrudes outwardly beyond said flight path when said saw chain is under said tension and in the absence of said advancing and cutting forces and a second position whereat said rearward lower edge lies approximately in the plane of one of the bearing surfaces in response to said advancing and cutting forces thereby providing the cutting edges of said cutting links with a predetermined clearance angle for penetrating and cutting the wood.

2. The saw chain of claim 1, wherein each of said guide paths includes a groove formed in the guide bar, the groove having two side walls and a base extending along the length of the path;

selected ones of said drive links being connected at the forward bores thereof to said selected working links, respectively, by being pivotally connected to said selected rearward pivot means of the working links corresponding thereto in such a manner that the center axis of said last-mentioned forward bores are coincident with the respective pivot axes of said rearward pivot means of said working links; and, the plate-like body of said drive links being configurated to extend downwardly from the rearward and forward bores thereof to engage the grooves of said guide paths and to define a foot tip which moves through the groove at a predetermined spacing from the base thereof.

3. The saw chain of claim 2, said drive links conjointly defining a center drive-link plane coincident with the plane of said guide bar, said working links being interconnected with said drive links so that one working link is connected between each two mutually adjacent ones of the drive links so as to cause every other one of said working links to be on one side of said drive-link plane and the remaining ones of said working links to be on the other side of said drive-link plane; said connecting links being disposed adjacent corresponding one of said working links so as to cause said drive links to be disposed therebetween; and, selected ones of said connecting links being disposed next to said selected ones of said working links and being connected to corresponding ones of said rearward pivot means having said ancillary means; and, said ancillary means being configured so as to permit said selected connecting links to pivot with said selected working links as the latter moves between said two positions.

4. A saw chain for a motor-driven chain saw equipped with a guide bar and a drive motor for imparting a pulling force to the saw chain for moving the latter around the guide bar, the guide bar having substantially linear upper and lower guide paths on its upper and lower edges, respectively, for guiding the saw chain and having a nose sprocket at its outermost end for directing the saw chain from one of said guide paths to the other one of said guide paths, the guide paths defining respective bearing surfaces along which the saw chain glides as it moves around the guide bar, each of said guide paths including a groove formed in the guide bar, the groove having two side walls and a base extending along the length of the path, the saw chain being subjected to advancing and cutting forces as the guide bar is advanced into the wood to be cut, the saw chain comprising:

a plurality of cutting links, a plurality of safety links, a plurality of connecting links and a plurality of driving links, the links being pivotally interconnected by rivets to define the saw chain;

said cutting links and said safety links defining a plurality of working links;

each of said links including a plate-like body having a rearward bore for accommodating one of the rivets and a forward bore for accommodating another one of said rivets;

said bores being located in the plate-like bodies of said links so as to cause said rivets to define respective pivot axes which are mutually parallel and lie in a common action plane located at a predetermined distance from said bearing surface when the saw chain is under the tension imparted thereto by said pulling force;

each of said working links having an upper working part facing away from the guide bar for acting upon the wood to be cut and a lower edge lying opposite said upper working part and being disposed in the region of said rearward bore, said upper working part having a rearward outer edge;

the upper working part of said cutting links each having a cutting edge defining a flight path as the saw chain moves around the guide bar at a predetermined distance from said guide bar;

pivot means pivotally connecting at least selected ones of said working links into said saw chain so as to cause each of the selected working links to pivot from a first position whereat said lower edge is at a predetermined spacing from the bearing surface of the guide path and whereat said rearward outer edge protrudes outwardly beyond said flight path when said saw chain is under said tension and in the absence of said advancing and said cutting forces and a second position whereat said lower edge lies approximately in the plane of one of the bearing surfaces in response to said advancing and cutting forces thereby providing the cutting edges of said cutting links with a predetermined clearance angle for penetrating and cutting the wood;

said pivot means being selected ones of said rivets mounted in corresponding ones of the rearward bores of said selected ones of said working links;

selected ones of said drive links being connected at the forward bores thereof to said selected working links, respectively, by being pivotally connected to said selected rivets in such a manner that the center axis of said last-mentioned forward bores are coincident with the respective pivot axes of said selected rivets; and, the plate-like body of said drive links being configured to extend downwardly from the rearward and forward bores thereof to engage the grooves of said guide paths and to define a foot tip which moves through the groove at a predetermined spacing from the base thereof;

said drive links conjointly defining a center drive-link plane coincident with the plane of said guide bar, said working links being interconnected with said drive links so that one working link is connected between each two mutually adjacent ones of the drive links so as to cause every other one of said working links to be on one side of said drive-link plane and the remaining ones of said working links to be on the other side of said drive-link plane; said connecting links being disposed adjacent corresponding ones of said working links so as to cause said drive links to be disposed therebetween; and, selected ones of said connecting links being disposed next to said selected ones of said working links and being connected to corresponding ones of said selected rivets; and, said selected rivets being configured so as to permit said selected connecting links to pivot with said selected working links as the latter moves between said two positions; and, said selected ones of said rivets each including: a center portion defining a bearing surface for receiving the forward bore of the drive link thereon; and, an eccentric trunnion formed on one side of said center portion for accommodating a selected working link thereon; said eccentric trunnion defining a trunnion axis lying above said action plane.

5. A saw chain for a motor-driven chain saw equipped with a guide bar and a drive motor for imparting a pulling force to the saw chain for moving the latter around the guide bar, the guide bar having substantially linear upper and lower guide paths on its upper and lower edges, respectively, for guiding the saw chain and having a nose sprocket at its outermost end for directing the saw chain from one of said guide paths to the other one of said guide paths, the guide paths defining respective bearing surfaces along which the saw chain glides as it moves around the guide bar, each of said guide paths including a groove formed in the guide bar, the groove having two side walls and a base extending along the length of the path, the saw chain being subjected to advancing and cutting forces as the guide bar is advanced into the wood to be cut, the saw chain comprising:

a plurality of cutting links, a plurality of safety links, a plurality of connecting links and a plurality of driving links, the links being pivotally interconnected by rivets to define the saw chain;

said cutting links and said safety links defining a plurality of working links;

each of said links including a plate-like body having a rearward bore for accommodating one of the rivets and a forward bore for accommodating another one of said rivets;

said bores being located in the plate-like bodies of said links so as to cause said rivets to define respective pivot axes which are mutually parallel and lie in a common action plane located at a predetermined distance from said bearing surface when the saw chain is under the tension imparted thereto by said pulling force;

each of said working linkshaving an upper working part facing away from the guide bar for acting upon the wood to be cut and a lower edge lying opposite said upper working part and being disposed in the region of said rearward bore, said upper working part having a rearward outer edge;

the upper working part of said cutting links each having a cutting edge defining a flight path as the saw chain moves around the guide bar at a predetermined distance from said guide bar;

pivot means pivotally connecting at least selected ones of said working links into said saw chain so as to cause each of the selected working links to pivot from a first position whereat said lower edge is at a predetermined spacing from the bearing surface of the guide path and whereat said rearward outer edge protrudes outwardly beyond said flight path when said saw chain is under said tension and in the absence of said advancing and said cutting forces and a second position whereat said lower edge lies approximately in the plane of one of the bearing surfaces in response to said advancing and cutting forces thereby providing the cutting edges of said cutting links with a predetermined clearance angle for penetrating and cutting the wood;

said pivot means being selected ones of said rivets mounted in corresponding ones of the rearward bores of said selected ones of said working links;

selected ones of said drive links being connected at the forward bores threof to said selected working links, respectively, by being pivotally connected to said selected rivets in such a manner that the center axis of said last-mentioned forward bores are coincident with the respective pivot axes of said selected rivets; and, the plate-like body of said drive links being configured to extend downwardly from the rearward and forward bores thereof to engage the grooves of said guide paths and to define a foot tip which moves through the groove at a predetermined spacing from the base thereof;

said drive links conjointly defining a center drive-link plane coincident with the plane of said guide bar, said working links being interconnected with said drive links so that one working link is connected between each two mutually adjacent ones of the drive links so as to cause every other one of said working links to be on one side of said drive-link plane and the remaining ones of said working links to be on the other side of said drive-link plane; said connecting links being disposed adjacent corresponding ones of said working links so as to cause said drive links to be disposed therebetween; and, selected ones of said connecting links being disposed next to said selected ones of said working links and being connected to corresponding ones of said selected rivets; and, said selected rivets being configured so as to permit said selected connecting links to pivot with said selected working links as the latter moves between said two positions; and, said selected ones of said rivets each including a center portion defining a bearing surface for receiving the forward bore of the drive link thereon; and, two eccentric trunnions formed on respective sides of said center portion for accommodating a selected working link and a selected connecting link thereon, respectively; said eccentric trunnions defining respective trunnion axes lying above said action plane.

6. The saw chain of claim 5, said axes of said eccentric trunnions being coaxial.

7. The saw chain of claim 5, said eccentric trunnions and the bores of the links mounted thereon all having a non-circular contour and forming respective form-tight connections.

8. The saw chain of claim 7, said non-circular contours being polygonal.

9. The saw chain of claim 1, each of said working links having a lower edge facing the bearing surfaces of the guide paths, said lower edge having contact engaging portions beneath respective ones of the two bores of the working link; said two bores being at respectively different distances from said contact engaging portions so as to cause the rearward contact engaging portion and said bearing surface to conjointly define a gap therebetween when the working link is in said first position; said gap corresponding to the distance that said rearward outer edge protrudes outwardly beyond said flight path.

10. A saw chain for a motor-driven chain saw equipped with a guide bar and a drive motor for imparting a pulling force to the saw chain for moving the latter around the guide bar, the guide bar having substantially linear upper and lower guide paths on its upper and lower edges, respectively, for guiding the saw chain and having a nose sprocket at its outermost end for directing the saw chain from one of said guide paths to the other one of said guide paths, the guide paths to the other one of said guide paths, the guide paths defining respective bearing surfaces along which the saw chain glides as it moves around the guide bar, the saw chain being subjected to advancing and cutting forces as the guide bar is advanced into the wood to be cut, the saw chain comprising:

a plurality of cutting links, a plurality of safety links, a plurality of connecting links and a plurality of driving links, the links being pivotally interconnected by a plurality of forward pivot means and a plurality of rearward pivot means to define the saw chain;

said cutting links and said safety links defining a plurality of working links;

each of said links including a plate-like body having a rearward bore for accommodating one of said rearward pivot means and a forward bore for accommodating one of said forward pivot means;

said bores being located in the plate-like bodies of said links so as to cause said pivot means to define respective pivot axes which are mutually parallel and lie in a common action plane located at a predetermined distance from said bearing surface when the saw chain is under the tension imparted thereto by said pulling force;

each of said working links having an upper working part facing away from the guide bar for acting upon the wood to be cut and a rearward lower edge lying opposite said upper working part and being disposed in the region of said rearward bore and a forward lower edge disposed in the region of said forward bore;

said forward pivot means pivotally connecting said working links into said saw chain so as to hold the forward lower edge of each of said working links in contact engagement with one of the bearing surfaces of the guide path in response to said pulling force irrespective of the presence of said advancing and cutting forces; and, at least selected ones of said rearward pivot means including ancillary means for permitting corresponding selected ones of said working links to pivot downwardly about said forward pivot means from a first position whereat said rearward lower edge is at a predetermined spacing from the bearing surface of the guide path when said saw chain is under said tension and in the absence of said advancing and cutting forces and a second position whereat said rearward lower edge lies approximately in the plane of the bearing surfaces in response to said advancing and cutting forces thereby providing the cutting edges of said cutting links with a predetermined clearance angle for penetrating and cutting the wood.

* * * * *

UNITED STATES PATENT AND TRADEMARK OFFICE

CERTIFICATE OF CORRECTION

PATENT NO. : 4,756,221

DATED : July 12, 1988

INVENTOR(S) : Karl Nitschmann, Hans Dolata and Werner Hartmann

It is certified that error appears in the above-identified patent and that said Letters Patent is hereby corrected as shown below:

In column 9, line 10: insert -- region of said rearward bore, said upper working part having a -- between "the" and "rearward".

In column 9, line 47: delete "configurated" and substitute -- configured -- therefor.

In column 9, line 62: delete "one" and substitute -- ones -- therefor.

In column 12, line 1: delete "linkshaving" and substitute -- links having -- therefor.

In column 12, line 30: delete "threof" and substitute -- thereof --

In column 13, line 30: delete the entire line as follows: "paths to the other one of said guide paths, the guide".

Signed and Sealed this

Twenty-ninth Day of August, 1989

*Attest:*

DONALD J. QUIGG

*Attesting Officer*

*Commissioner of Patents and Trademarks*